United States Patent [19]

Shirosaki et al.

[11] Patent Number: 4,994,235

[45] Date of Patent: Feb. 19, 1991

[54] WEAR-RESISTANCE ALUMINUM BRONZE ALLOY

[75] Inventors: Takehiro Shirosaki, Fujisawa; Takashi Kikkawa, Isehara; Hirotaka Toshima, Yamato, all of Japan

[73] Assignee: Oiles Corporation, Tokyo, Japan

[21] Appl. No.: 431,562

[22] Filed: Nov. 3, 1989

[30] Foreign Application Priority Data

Nov. 4, 1988 [JP] Japan ..... 63-280199

[51] Int. Cl.[5] ..... C22C 9/06

[52] U.S. Cl. ..... 420/495; 420/478; 420/479; 420/485; 420/486

[58] Field of Search ..... 420/478, 479, 485, 486, 420/495

[56] References Cited

U.S. PATENT DOCUMENTS

| | | | |
|---|---|---|---|
| 2,430,419 | 11/1947 | Edens | 420/486 |
| 2,798,826 | 7/1977 | Klement | 420/486 |
| 3,459,544 | 8/1969 | Watanabe | 420/486 |
| 3,650,733 | 3/1972 | Bobylev et al. | 420/486 |
| 3,793,009 | 2/1974 | Katsitadze et al. | 420/486 |
| 4,634,477 | 1/1987 | Sugimoto et al. | 420/486 |

FOREIGN PATENT DOCUMENTS

| | | | |
|---|---|---|---|
| 0206165 | 1/1984 | German Democratic Rep. | 420/479 |
| 1034895 | 7/1966 | United Kingdom | 420/479 |

*Primary Examiner*—Upendra Roy

*Attorney, Agent, or Firm*—David G. Conlin; Linda M. Buckley

[57] ABSTRACT

Disclosed herein is a wear-resistance aluminum bronze alloy comprising 4 to 15 wt % of Al, 0.1 to 10 wt % of Cr and the balance Cu, and optionally containing not more than 6 wt % of Ni and not more than 15 wt % of Mn.

5 Claims, No Drawings

WEAR-RESISTANCE ALUMINUM BRONZE ALLOY

BACKGROUND OF THE INVENTION

The present invention relates to a wear-resistance aluminum bronze alloy which is suitable for use of a sliding member of a rolling mill, machine tool, apparatuses for ships as well as apparatuses for automobiles.

As sliding member comprising an aluminum bronze alloy to be used for the above use, an aluminum bronze of Cu-Al-Fe alloy, Cu-Al-Fe-Ni alloy or Cu-Al-Fe-Ni-Mn alloy in which to copper containing not more than 15 wt % of aluminum were added iron, iron and nickel, or iron, nickel and manganese, respectively, has heretofore been used in many cases.

The following copper alloys have conventionally been proposed.

Japanese Patent Publication No. 44-28789 (1969) discloses a wear-resistance copper alloy having improved wear-resistance and mechanical strength so as to be usable under high-speed and high-load conditions, produced by adding not more than 1.0 wt % in total of at least one selected from the group consisting of Cr, Ti, V and Zr to an alloy containing 55 to 67 wt % of Cu, 1.0 to 6.0 wt % of Mn, 0.1 to 1.2 wt % of Si, 0.1 to 6 wt % of Al, 0.1 to 3.0 wt % of Pb and the balance Zn.

Japanese Patent Application Laid-Open (KOKAI) No. 49-66527 (1974) discloses a wear-resistance copper alloy having improved wear-resistance at a high temperature, produced by adding not more than 10 wt % in total of at least one selected from the group consisting of Mn, Cr, Bi to an alloy containing 60 to 85 wt % of Cu, 6 to 13 wt % of Al, 3 to 20 wt % of Ni, 1 to 10 wt % of Co as the main ingredients.

Japanese Patent Publication No. 50-7010 (1975) discloses a copper alloy for a valve seat with excellent anti-seizing property and wear-resistance at a high temperature, comprising 25 to 40 wt % of Zn, 1 to 8 wt % of Al, 1 to 5 wt % of Mg, 0.3 to 2 wt % of Si, 0.8 to 3 wt % of Cr, 0.3 to 1 wt % of P, not more than 5 wt % of impurity elements and the balance Cu.

Japanese Patent Application Laid-Open (KOKAI) No. 51-133127 (1976) discloses a wear-resistance aluminum bronze for sliding member having excellent adhesive wear-resistance and anti-seizing property, characterized in that the amount of iron silicate dispersed in the Cu-Al alloy is not smaller than the eutectic composition in the quasibinary phase diagram of a Cu-Al phase and an iron silicate phase.

Japanese Patent Publication No. 52-50724 (1977) discloses an age-hardening copper alloy for a bearing or a clock, which comprises 5 to 35 wt % of Zn, 1 to 20 wt % of Ni, more than 1 wt % to not more than 8 wt % of Al and the balance substantially Cu, wherein an intermetallic compound of Ni, and Al is mainly separated out by heat-treatment.

Japanese Patent Application Laid-Open (KOKAI) No. 63-157825 (1988) discloses a wear-resistance alloy comprising 10 to 40 wt % of Zn, 3 to 10 wt % of Al, 0.1 to 4 wt % of Cr and the balance Cu.

Japanese Patent Publication No. 7-3943 (1933) discloses an alloy having magnetic property, excellent tensile strength and hardness as well as abrasion resistance and corrosion resistance, which comprises 40 to 85 wt % of Cu, 1 to 50 wt % of Fe, 0.1 to 35 wt % of Ni, 0.1 to 5 wt % of Cr and 0.1 to 7 wt % of Al.

Japanese Patent Application Laid-Open (KOKAI) No. 48-66525 (1973) discloses a copper alloy having wear-resistance at high temperature, which comprises 25 to 55 wt % of Fe, 2 to 8 wt % of Al, 1 to 10 wt % of Cr, 1 to 10 wt % of Ni and the balance Cu.

As an aluminum bronze alloy for a sliding member, a high-strength aluminum bronze alloys regulated by JIS H 5114 No. 3, which comprises not less than 78 wt % of Cu, 3.0 to 6.0 wt % of Fe, 8.5 to 10.5 wt % of Al, 3.0 to 6.0 wt % of Ni, not more than 1.5 wt % of Mn and not more than 0.5 wt % of impurity elements, which corresponds to ASTM B148 C 95800, the composition comprising not less than 78 wt % of Cu, 3.5 to 4.5 wt % of Fe, 8.5 to 9.5 wt % of Al, 4.0 to 5.0 wt % of Ni, 0.8 to 1.5 wt % of Mn, not more than 0.02 wt % of Si and not more than 0.05 wt % of Pb; and by JIS H 5114 No. 4, which comprises not less than 71 wt % of Cu, 2.0 to 5.0 wt % of Fe, 6.0 to 9.0 wt % of Al, 1.0 to 4.0 wt % of Ni, 7.0 to 15.0 wt % of Mn and not more than 0.5 wt % of impurity elements, which corresponds to ASTM B 148 C 95700, the composition comprising not less than 71.0 wt % of Cu, 2.0 to 4.0 wt % of Fe, 7.0 to 8.5 wt % of Al, 1.5 to 3.0 wt % of Ni, 11.0 to 14.0 wt % of Mn, not more than 0.03 wt % of Pb and not more than 0.10 wt % of Si.

When aluminum bronze is used as a sliding member, it is necessary to use it usually by supplying a lubricating oil composition such as grease, oil, etc. In using under the conditions of high temperature or in water at which the lubricating oil composition cannot be used, it is also necessary to use it by laying or coating a solid lubricating agent such as graphite, molybdenum disulfide, etc. at the sliding surface.

That is, a sliding member comprising aluminum bronze has advantages that it is (1) excellent in corrosion resistance and (2) excellent in mechanical strength, and (3) can be improved in its mechanical characteristics by quenching and annealing treatments, etc., since structural transformation is possible due to heat-treatment. To the contrary, it has disadvantage in friction wear characteristics, particularly, cohesive wear is likely caused so that it is inferior in anti-seizing property and involves the problem that remarkable decrease in wear-resistance is caused during usage under the conditions of low-speed and high-load for a long period of time.

Further, although these aluminum bronzes have characteristic of excellent in corrosion resistance, when these aluminum bronzes are, for example, used in sea water, there involve the problem that rapid decrease in corrosion resistance is cause with increase of iron in the compositional range of the aluminum bronzes containing less amount of nickel as compared with that of iron.

As a result of the present inventors' studies to solve the above-mentioned problems, it has been found that by adding chromium in place of iron in the composition of the conventional aluminum bronze, i.e. a wear-resistance aluminum bronze comprising 4 to 15 wt % of Al, 0.1 to 10 wt % of Cr and the balance Cu, and a wear-resistance aluminum bronze in which to the above composition is/are added not more than 6 wt % of nickel, or not more than 6 wt % of nickel and not more than 15 wt % of Mn, can be improved in sliding characteristics such as adhesive wear-resistance and anti-seizing property, and also exhibit excellent corrosion resistance during usage in sea water. The present invention has been achieved on the basis of this finding.

SUMMARY OF THE INVENTION

An object of the present invention is to provide an aluminum bronze which is improved in adhesive wear-resistance and anti-seizing property and exhibits excellent corrosion resistance during usage in sea water without impairing mechanical properties of a sliding member comprising the conventional aluminum bronze.

In an aspect of the present invention, there is provided a wear-resistance aluminum bronze alloy comprising 4 to 15 wt % of Al, 0.1 to 10 wt % of Cr and the balance Cu.

In a second aspect of the present invention, there is provided a wear-resistance aluminum bronze alloy comprising 4 to 15 wt % of Al, 0.1 to 10 wt % of Cr, not more than 6 wt % of Ni and the balance Cu.

In a third aspect of the present invention, there is provided a wear-resistance aluminum bronze alloy comprising 4 to 15 wt % of Al, 0.1 to 10 wt % of Cr, not more than 6 wt % of Ni, not more than 15 wt % of Mn and the balance Cu.

DETAILED DESCRIPTION OF THE INVENTION

Cu is a main ingredient of an aluminum bronze alloy of the present invention and contributes to excellent thermal conductivity and corrosion resistance. When Cu is reacted with oxygen in air, a copper oxide thin film is formed on the surface thereof and the thus formed thin film is self-lubricating and contributes to a wear-resistance of the alloy. The Cu content is the balance determined by the content of Al and Cr.

Al contributes to the mechanical properties, in particular, the strength and hardness. The preferred amount of Al is 4 to 15 wt % in consideration of the casting properties and machine-working property of the alloy and, especially, when it is 7 to 12 wt %, the greatest effects is exhibited.

Cr is formed as a precipitate without alloying with other elements, and is an element useful for making an alloy structure fine, increasing the strength and improving corrosion resistance. Addition of more than 10 wt % of Cr, however, is apt to deteriorate the machining property and the casting properties. On the other hand, addition of less than 0.1 wt % of Cr does not fully exhibit the effect of addition. Therefore, the preferred amount of Cr to be added is 0.1 to 10 wt %, more preferably 0.5 to 8.0 wt % and, especially, when it is 1.0 to 5.0 wt %, the greatest effect is exhibited.

Ni is an element further added to an alloy composed of Al, Cr and the balance Cu in order to increase the mechanical properties of the alloy. However, if too large an amount of Ni is added, the wear-resistance is apt to be rather deteriorated, so that the preferred amount of Ni added is not more than 6 wt %, particularly, not more than 4 wt % is suitable.

Mn is an element further added to an alloy composed of Al, Cr, Ni and the balance Cu in order to increase the mechanical properties of the alloy and also to restrain an embrittlement of the aluminum bronze by annealing. However, if the amount of Mn added is more than 15 wt %, the elongation of the alloy is apt to be greatly reduced, so that the amount of Mn added is preferably not more than 15 wt %, particularly, not more than 12 wt % is suitable.

A known method can be adopted for producing an aluminum bronze alloy of the present invention.

The wear-resistance aluminum bronze alloy of the present invention exhibits an excellent wear-resistance, for example, a specific depth of wear is not more than $25\times10^{-6}$ mm/m, preferably not more than $18\times10^{-6}$ mm/m, more preferably not more than $14\times10^{-6}$ mm/m and anti-seizing property, and also exhibits excellent corrosion resistance during usage in sea water.

The present invention will be explained hereinunder with reference to the following nonlimitative examples.

EXAMPLE 1

Cu was melted in a graphite crucible at 1,300° C. and Al and Cu-10% Cr mother alloy were added to the molten metal and melted so that the alloy had a predetermined composition. The molten metal was pored into a sand mold while maintaining the temperature thereof at 1,200° C. to prepare cylindrical castings.

EXAMPLE 2

Cu was melted in a graphite crucible at 1,300° C. and Al, Cu-10% Cr mother alloy and Cu-30% Ni mother alloy were added to the molten metal and melted so that the alloy had a predetermined composition. The molten metal was pored into a sand mold while maintaining the temperature thereof at 1,200° C. to prepare cylindrical castings.

EXAMPLE 3

Cu was melted in a graphite crucible at 1,300° C. and Al, Cu-10% Cr mother alloy, Cu-30% Ni mother alloy and Cu-25% Mn mother alloy were added to the molten metal and melted so that the alloy had a predetermined composition. The molten metal was pored into a sand mold while maintaining the temperature thereof at 1,200° C. to prepare cylindrical castings.

The following Table shows the composition of the aluminum bronze obtained in each example and the results of wear-resistance test of the obtained aluminum bronzes.

The wear-resistance tests in the Table are results carried out under the following conditions.

Test piece: The cylindrical castings obtained by the above examples were machined to prepare cylindrical bearings having dimensions of 60 mm in inner diameter, 75 mm in outer diameter and 40 mm in length. After 40 pieces of graphite solid lubricants of 8 m in diameter were embedded in the sliding surface so as to overlap with each other in the sliding direction and thereafter it was soaked with lubricating oil by oil-impregnation treatment. (27% of a solid lubricant was exposed to the sliding surface).

Mating shaft material: Structural carbon steel plated with hard chromium on the surface thereof Sliding speed: 0.5 m/min Load : 18,000 kgf (reciprocal oscillation motion journal load)

Oscillation angle: ±45°

Total sliding distance: 2820 m

Also, as Comparative Example in the Table, aluminum bronze alloy according to JIS H 5114 was tested under the same conditions as above.

TABLE

| | Sample No. | Composition (wt %) Cu | Al | Cr | Ni | Mn | Fe | Specific depth of wear ($\times 10^{-6}$ mm/m) |
|---|---|---|---|---|---|---|---|---|
| Example 1 | 1 | Balance | 9.1 | 8.0 | — | — | — | 14.8 |
| | 2 | Balance | 10.8 | 4.9 | — | — | — | 12.2 |
| Example 2 | 3 | Balance | 8.8 | 1.2 | 3.2 | — | — | 13.3 |
| | 4 | Balance | 8.5 | 3.1 | 1.4 | — | — | 10.7 |
| Example 3 | 5 | Balance | 7.4 | 2.4 | 1.6 | 8.0 | — | 11.4 |
| | 6 | Balance | 8.3 | 0.5 | 1.0 | 3.3 | — | 15.1 |
| Comparative example | 7 | Balance | 8.8 | — | 1.5 | 8.2 | 3.1 | 37.4 |
| | 8 | Balance | 9.2 | — | 3.9 | — | 4.1 | 42.7 |

Note

*1 Specific Depth of Wear: The depth of wear was calculated from the difference between the dimension before the test and the dimension after the test.

$$\text{Specific depth of wear (mm/m)} = \frac{\text{Depth of wear (mm)}}{\text{Total sliding distance (m)}}$$

According to the Table as mentioned above, it can be understood that Samples No. 1, 2, 3, 4, 5 and 6 are remarkable improved in wear-resistance as compared with Comparative Example In the following, the reason why the wear-resistance of the aluminum bronze alloys of the present invention is improved is considered.

It is not clear the reason why the aluminum bronze alloys in the present Examples are remarkably improved in wear-resistance as compared with Comparative Example, i.e. the conventional aluminum bronze alloys, but from the observation of friction surfaces of the bearings and mating material, it would be caused by formation of oxides of Cr in the components at the friction surfaces.

That is, an alloy structure of the aluminum bronze alloys of the present invention shows a structure in which Cr is substantially uniformly deposited in a phase copresenting $\alpha$ phase and $\beta$ phase. This deposited Cr forms Cr oxides by friction with the mating material and the Cr oxide is gradually formed on the friction surface as an oxide film. Thus, it can be considered that sliding between the bearings and the mating material are shifted to friction through the oxide film.

What is claimed is:

1. A wear-resistance aluminum bronze alloy consisting essentially of 7 to 15 wt % of Al, 0.1 to 10 wt % of Cr and the balance copper, and showing a specific depth of wear of not more than $25\times10^{-6}$ mm/m.

2. A wear-resistance aluminum bronze alloy consisting essentially of 7 to 15 wt % of Al, 0.1 to 10 wt % of Cr, not more than 6 wt % of Ni and the balance Cu, and showing a specific depth of wear of not more than $25\times10^{-6}$ mm/m.

3. A wear-resistance aluminum bronze alloy according to claim 2, wherein the content of Ni is not more than 4 wt %.

4. A wear-resistance aluminum bronze alloy consisting essentially of 7 to 15 wt % of Al, 0.1 to 10 wt % of Cr, not more than 6 wt % of Ni, not more than 15 wt % of Mn and the balance Cu, and showing a specific depth of wear of not more than $25\times10^{-6}$ mm/m.

5. A wear-resistance aluminum bronze alloy according to claim 4, wherein the content of Ni is not more than 4 wt %.

* * * * *